US010547946B2

(12) United States Patent
Lee et al.

(10) Patent No.: US 10,547,946 B2
(45) Date of Patent: Jan. 28, 2020

(54) WEARABLE DEVICE

(71) Applicant: LG ELECTRONICS INC., Seoul (KR)

(72) Inventors: Kyungik Lee, Seoul (KR); Jongjoo Moon, Seoul (KR); Jaehyun Oh, Seoul (KR); Jaeyoung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/947,554

(22) Filed: Apr. 6, 2018

(65) Prior Publication Data

US 2018/0367899 A1 Dec. 20, 2018

(30) Foreign Application Priority Data

Jun. 16, 2017 (KR) ..... 10-2017-0076519

(51) Int. Cl.

| | |
|---|---|
| ***H04R 5/033*** | (2006.01) |
| ***H01Q 3/24*** | (2006.01) |
| ***H01Q 1/24*** | (2006.01) |
| ***H01Q 25/00*** | (2006.01) |
| ***H01Q 1/27*** | (2006.01) |
| *H04R 1/10* | (2006.01) |
| *H01Q 1/22* | (2006.01) |

(52) U.S. Cl.

CPC ..... *H04R 5/0335* (2013.01); *H01Q 1/273* (2013.01); *H01Q 3/24* (2013.01); *H01Q 1/2291* (2013.01); *H04R 1/1041* (2013.01); *H04R 2420/07* (2013.01)

(58) Field of Classification Search

CPC .... H04R 5/0335; H04R 1/1041; H04R 5/033; H04R 1/10; H01Q 3/24; H05K 1/147

USPC ..... 381/74, 311, 26; 379/420.04, 420.03, 379/420.02, 420.01

See application file for complete search history.

(56) References Cited

U.S. PATENT DOCUMENTS

2018/0070179 A1* 3/2018 McAuliffe ..... H01Q 1/38

FOREIGN PATENT DOCUMENTS

| | | |
|---|---|---|
| JP | 2016146518 | 8/2016 |
| KR | 1020100080931 | 7/2010 |

(Continued)

OTHER PUBLICATIONS

PCT International Application No. PCT/KR2018/004014, Notification of Transmittal of the International Search Report and the Written Opinion of the International Searching Authority, or Declaration dated Sep. 7, 2018, 11 pages.

*Primary Examiner* — Thjuan K Addy

(74) *Attorney, Agent, or Firm* — Lee Hong Degerman Kang & Waimey

(57) ABSTRACT

A wearable device that includes a first body part, a second body part and a main circuit board located in the first body part. The device further includes a wireless communication unit mounted on the main circuit board, a divider mounted on the main circuit board and first and second antennas. The first antenna is located in the first body part and is coupled to the divider, and the second antenna is located in the second body part at a distance from the first antenna. The first body part is located at a front side of a user wearing the device and the second body part is located at a lateral side or rear side of the user wearing the wearable device. The device also includes a coaxial cable connecting the divider and the second antenna.

10 Claims, 9 Drawing Sheets

(56) References Cited

FOREIGN PATENT DOCUMENTS

| | | |
|---|---|---|
| KR | 1020100091258 | 8/2010 |
| KR | 1020140123813 | 10/2014 |
| KR | 1020160026401 | 3/2016 |

* cited by examiner (a)

FIG. 6

| | Free TRP(Total Radiated Power) (dBm) | | | |
|---|---|---|---|---|
| Channel Number | 0 | 39 | 78 | Avg. |
| Single antenna | 0.12 | 1.6 | 1.68 | 1.19 |
| Dual antenna | 0.75 | 2.19 | 2.11 | 1.73 |

| | Free TIS(Total Isotropic Sensitivity) (dBm) | | | |
|---|---|---|---|---|
| FChannel Number | 0 | 39 | 78 | Avg. |
| Single antenna | -85.04 | -84.08 | -83.75 | -84.32 |
| Dual antenna | -83.53 | -84.03 | -83.86 | -83.81 |

(a)

(b)

WEARABLE DEVICE

CROSS-REFERENCE TO RELATED APPLICATIONS

Pursuant to 35 U.S.C. § 119(a), this application claims the benefit of earlier filing date and right of priority to Korean Patent Application No. 10-2017-0076519, filed on Jun. 16, 2017, the contents of which are all hereby incorporated by reference herein in their entirety.

BACKGROUND OF THE DISCLOSURE

Field of the Disclosure

Embodiments of the present disclosure relate to a wearable device which includes a wireless communication unit configured to transceive data with an external terminal by wireless communication and is wearable on a user's body for hand carrying.

Background of the Disclosure

A wearable device means the electronic equipment which a user is able to wear on the body part to carry with him or her. Typical examples of such wearable devices include smart watches, smart glasses, HMD (Head Mounted Displays), neckbands and the like to simply enhance the hand-carry mobility of mobile terminals.

The wearable device may be configured to transceiver (or interwork) data with one or more other mobile terminals. The wearable device is linked with an external terminal via a short range communication module and immediately connected without any auxiliary authentication processes, in case of an authenticated device. Also, the wearable device is able not only to receive data from other mobile terminals but also to transmit the collected data (for example, the voice or user input collected via a microphone or user input unit) to other mobile terminals.

In this instance, wireless communication uses electromagnetic waves and then become likely to be affected by a user's body part. Such a conventional wearable device need solving the disadvantages caused when held by a user in the hand. Especially, the conventional wearable device performs wireless communication while being worn on the user's body part so that it might have a disadvantage of degraded performance.

SUMMARY OF THE DISCLOSURE

Accordingly, an object of the present invention is to address the above-noted and other problems.

An object of the present disclosure is to provide a wearable device configured to transceive data with other terminals by wireless communication, which includes an antenna capable of preventing the deteriorated wireless communication performance caused by human body parts.

Embodiments of the present disclosure may provide a wearable device comprising a body wearable on a user's body part; a wireless communication chipset loaded in the body and configured to transceive a signal; a divider connected with the wireless communication chipset; a first antenna connected with the divider and loaded in the body; and a second antenna connected with the divider and loaded in the body, spaced a preset distance apart from the first antenna.

The body may comprise a first body part configured to be located in the user's front when the user is wearing the wearable device; and a second body part configured to be located in the user's side or back when the user is wearing the wearable device.

The body may comprise a band part with elasticity; and a pair of housing coupled to both ends of the band part, and the first part is one end of the housing, spaced a preset distance apart from the band part and the second part is the other end of the housing, adjacent to the band part.

The wireless communication chipset and the divider may be disposed in the first part.

The wearable device may further comprise a main board disposed in the first part and having the wireless communication chipset and the divider loaded thereon; and a coaxial cable having one end coupled to the main board to be connected with the divider and the other end connected with the second antenna.

The second antenna may be a dipole antenna comprising a first radiator connected with the wireless communication chipset via the divider and a second radiator connected with a ground.

The wearable device may further comprise a coaxial cable configured to connect the divider and the second antenna with each other and comprising a signal line; a ground shield located around the signal line; and an insulated coating configured to surround the ground shield, wherein the first radiator is connected with the signal line and the second radiator is connected with the ground shield.

The first radiator and the second radiator may be arranged in a V-shape or an I-shape.

The divider may be configured to divide and transmit the electricity output from the wireless communication chipset to the first and second antennas and combine and transmit the signals received from the first and second antennas to the wireless communication chipset.

The divider may comprise at least one of a conductive pattern and a lumped element and a coupler.

The wearable device may further comprise a control unit configured to control the divider to connect the second antenna with the wireless communication chipset, when the wireless communication performance of the first antenna is deteriorated, wherein the divider comprises a switch for selectively connecting the wireless communication chipset with the first or second antenna.

The wearable device may further comprise one or more auxiliary dividers disposing between the divider and the first antenna an/or the second antenna; and a third antenna connected with the one or more auxiliary dividers.

The wearable device in accordance with the present disclosure has following effects.

According to at least one embodiment mentioned above, the wearable device is capable of securing wireless communication performance, regardless of the location of the other terminal communicable with the wearable device while the user is wearing the wearable device. Especially, the wireless communication performance can be improved, using the conventional wireless communication chipset, and the wearable device has the advantage of no drastic rise in unit cost, compared with the conventional product.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 6 is a graph to compare the wireless communication performance of the conventional wearable device with that of the wearable device in accordance with the present disclosure;

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
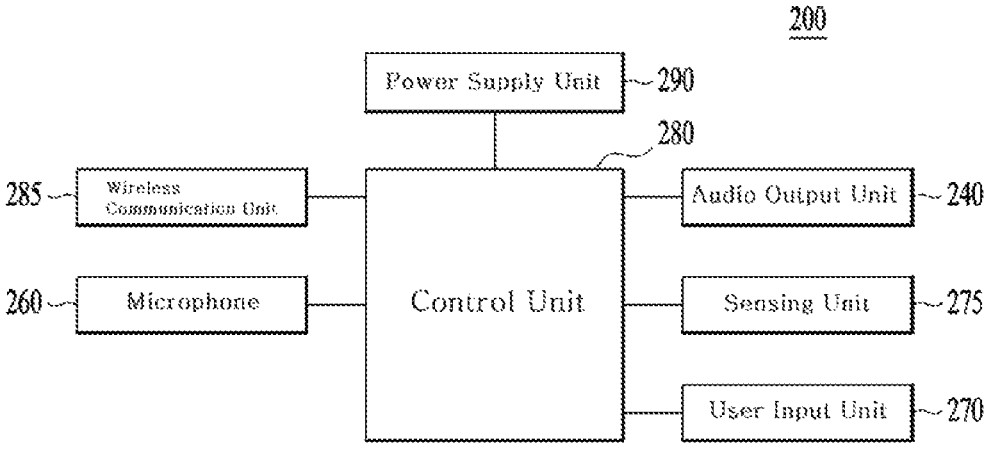
FIG. 1 is a block diagram of a wearable device in accordance with the present disclosure.
Figure 2:
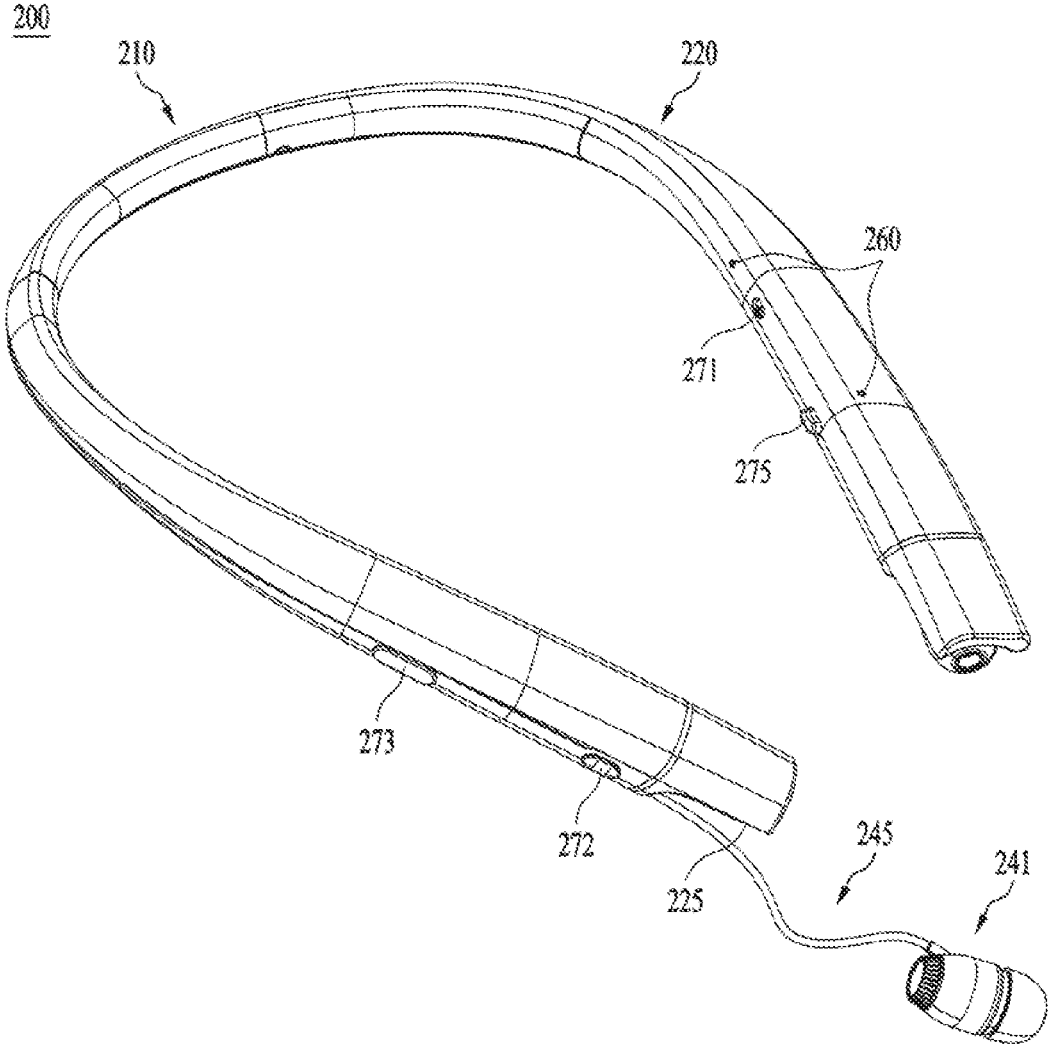
FIG. 2 is a perspective diagram illustrating one example of a watch type terminal in accordance with one exemplary embodiment of the present disclosure, viewed from one direction.

FIG. 1 is a block diagram of a wearable device 200 in accordance with the present disclosure and FIG. 2 is a perspective diagram illustrating one example of a watch type terminal 200 in accordance with one exemplary embodiment of the present disclosure, viewed from one direction. The wearable device 200 includes a control unit 280, a wireless communication unit 285, a sound output unit 240, a sensing unit 275, a microphone 260, a user input unit 270 and a power supply unit 290.

A body of the wearable device 200 is worn on a user's body part for the user to carry in the hand. The body includes a first body part configured to be located in a first direction of the user's body part, when worn on the user's body; and a second body part configured to be located in a second direction of the user's body, for easily understandable description sake.

The body of the wearable device in accordance with the illustrated embodiment may include a band part 210; and a pair of housings 220 coupled to both ends of the band part 210. As shown in FIG. 2, the body defines a C-shaped curve. The body of the wearable device 200 is not limited to such a neckband type and it may include all types of wearable devices 200 including two body parts such as ring-shaped neck-wearable type like a necklace and a head mount device.

The band part 210 is configured to be located on a back side of the user's neck when the user is wearing the wearable device and has elasticity. When an external force is applied, the band part 210 is deformed in a preset range of areas. When the force is removed, the band part 210 returns to its original position. The band part 210 may include a shape memory alloy to restitute and a signal line for transmitting signals or electric power between components which are located in the housings 220 arranged in both ends of the band part 210. The band part 210 may include urethane to enlarge a diameter of the C-shaped body once the user applies a force to the band part 210 and both ends of the band part 210 may further include brackets made of a solid material to connect the housings 220 with each other.

The housings 220 are coupled to both ends of the band part 210 and located in both ends of the C-shaped curve. Diverse internal components including a main printed circuit board, a wireless communication unit 285, a power supply unit 290 and a rotation module may be insertedly loaded inside and outside the housings 220.

The sound output unit 240 is provided as a device for outputting sound according to a sound signal and typical examples of the sound output unit 240 include an earbud 241 insertedly worn on the user's ear and configured to transmit sound to the user. The earbud 241 is detachable from an earbud holder 225 located in the housing 220 to be rested on an earbud holder 225 in case it is not used.

The earbud 241 may be connected with the main board loaded in the housing 220 via the sound cable 245. A predetermined region of the sound cable 245 may be consistently exposed outside or stored in the housing 220 by using the rotation module loaded in the housing. The former case has an advantage of the reduced components and the latter case can reduce the hand-carrying inconvenience caused by the sound cable 245.

Rather than the earbud 241, a speaker may be provided to deliver sound without being worn on the ear, so as to reduce the risk caused by the failure in hearing outside sounds when moving such as riding a bicycle, with wearing the earbud 241.

The microphone 260 is configured to process an external sound signal into electrical voice data and the processed voice data is transmitted to an external terminal or server by the wireless communication unit 285. In the microphone may be realized diverse noise canceling algorithms for removing the noise generated during the external sound signal receiving (that is, the noise canceling).

A plurality of microphones may be provided for the noise canceling and spaced a preset distance apart from each other, so as to analyze the sounds collected by each of them and distinguish the user's voice from noises. Also, a stereophonic sound can be realized by using the sounds collected by the plurality of the microphones 260.

The sensing unit 275 is a device configured to recognize a current state and surroundings of the wearable device 200. Examples of the sensing unit 275 include an illuminance sensor for sensing ambient light, a touch sensor for sensing touch input, a gyro-sensor for sensing a gradient and location of the wearable device 200 and an earbud switch for sensing a presence of the earbud 241 in the earbud holder 225.

As an alternative example, the sensing unit 275 may further include a wear sensor for sensing whether the user is wearing the body on the neck. The wear sensor may be configured to sense curvature variation of the band part 210 or include a proximity sensor, an illuminance sensor or a switch which is located in the band part. The wearable device 200 may be automatically activated by using the wear sensor and search another terminal to connect the searched terminal thereto via the wireless communication unit 285.

The user input unit 270 is provided as the input unit for allowing the user to control the wearable device 200. Examples of the user input unit 270 include a call button 272, a sound adjust button 273, a power button 271 and a storage button 275 for storing the sound cable 245 in the housing 220.

The user input unit 270 may include only one call button 272 and a pair of the sound adjust button 273 or further include a play/stop button and a play list change button. The size of the wearable device 200 is limited and the user is more likely to input orders, even without giving a look to the user input unit 270. If too many buttons are provided, it becomes difficult to distinguish each function of the buttons from each other. Accordingly, the time and frequency of button pressings and inputtable control commands may be expanded by using the limited number of the buttons and the combination of the buttons.

The control unit 280 is implemented to control the sound output unit 240 of the wearable device 200 and output sounds. It is also implemented to control the wireless communication unit 285 and transceive data with the external terminal. The control unit 280 may be configured to control the wearable device 200 or the other terminals connected via the wireless communication unit 285 according to the control command input from the user input unit 280.

The control unit 280 may include a main board (281, see FIG. 8) on which a circuit line is printed; and an IC loaded on the main board 281. If necessary, a flexible printed circuit board may be additionally used.

The wireless communication unit 285 transceive an electromagnetic wave and then data with other terminals. The wireless communication unit 285 may include one or more of broadcasting module, mobile communication module connectable with a mobile communication base station, wireless internet module, short range communication module, and location information module.

Typically, the wearable device 200 mainly serves as a sub device of the other terminal so as to supplement the functions of the other terminal, so that it can basically have the short range communication module. Examples of the short range communication include Bluetooth™, RFIF (Radio Frequency Identification), IrDA (Infrared Data Association), UWB (Ultra-Wideband), and ZigBee, NFC (Near Field Communication), Wi-Fi (Wireless-Fidelity), Wi-Fi Direct Wireless USB (Wireless Universal Serial Bus) and the like. Such the short range communication module is configured to support wireless communication between other terminals and the wearable device 200 by short range communication networks.

Bluetooth™ as the typical example of the short range communication is able to use signals in a bandwidth of 2.4 GHz and total 79 channels. As the short range communication technique, Bluetooth uses a high frequency and a high frequency signal has a short wavelength so as to be easily affected by the human body. In this instance, the wearable device 200 is always worn on the user's body part and located near the body part. Accordingly, it becomes important to enhance the wireless communication performance of the wearable device 200 by reducing the performance deterioration caused by the human body.

The power supply unit 290 is configured to supply the electric power for driving the components of the wearable device 200. One power supply unit 290 may be provided only in one housing 220 or two power supply units 290 may be provided in the two housings 220, respectively, to balance the weight between the housings 220.

The wireless communication unit 285 may include a wireless communication chipset 2851 for processing signals; and an antenna configured to transmit the signal generated in the wireless communication chipset 2851 to an external terminal or receive a signal from the external terminal and transmit the received signal to the wireless communication chipset 2851.

Figure 3:
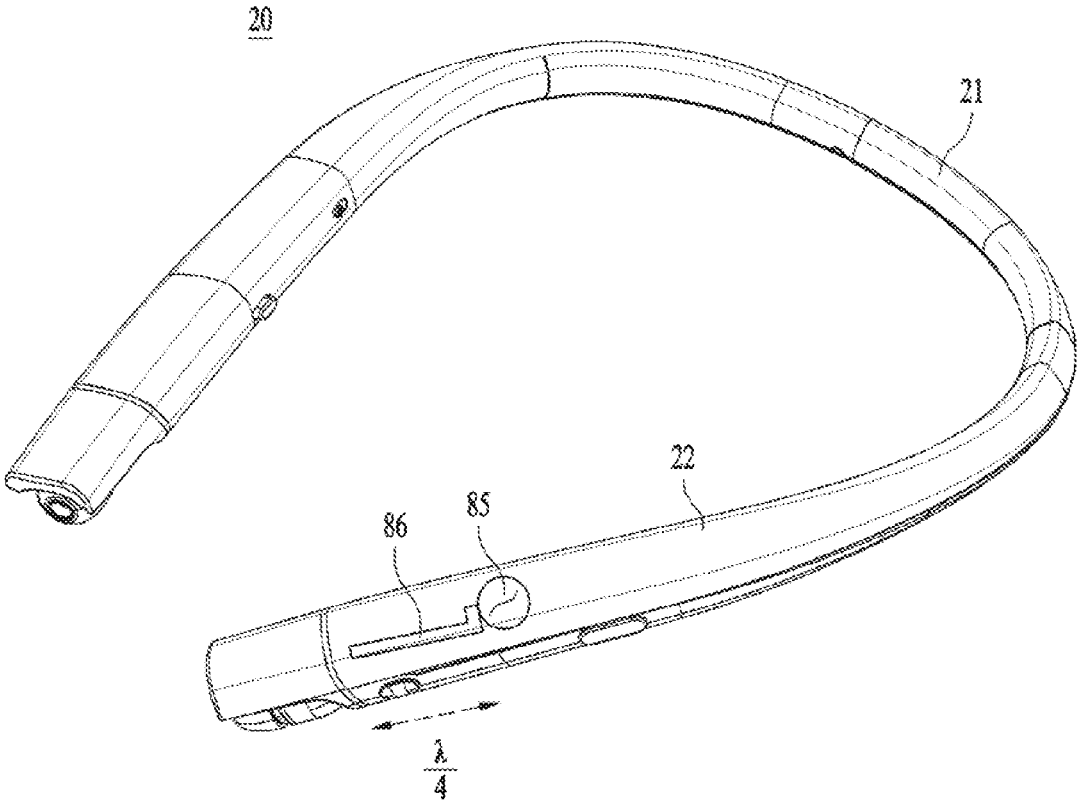
FIG. 3 is a diagram to describe antenna arrangement of a conventional wearable device.
Figure 3:
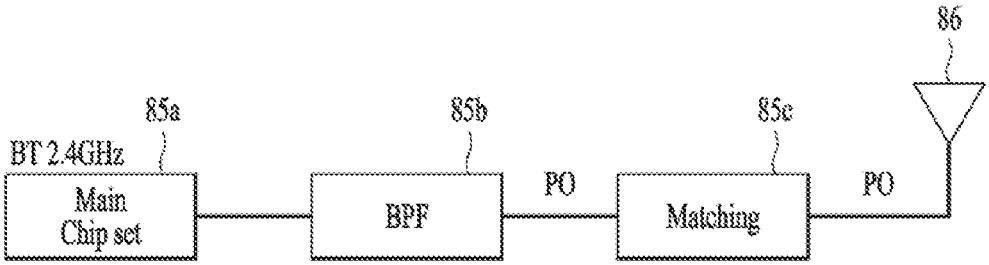

It is important in the wearable device 200 provided as the neckband type, which is wearable on the user's neck, in the present disclosure to arrange the antenna so as to minimize the influence of the user's body. FIG. 3 is a diagram to describe antenna arrangement of a conventional wearable device 10. In general, the user is holding the terminal connected with the wearable device in the hand so that the antenna 86 may be arranged in a first region located forward when the user is wearing the wearable device 10.

The wireless communication chipset 85*a* may be loaded on the main board and the antenna 86 may be arranged in an end of the housing 22 so as to minimize the effect of the other electronic components on the antenna and the effect of the human body. Or, it may be located in an upper surface opposite to a lower surface of the housing 22 in contact with the human body part. The antenna 86 is detachably located in an upper case of the housing 22 not to be exposed outside or it further includes an auxiliary case for covering the antenna 86.

Referring to FIG. 3(*b*), the wireless communication unit 285 may further include a matching circuit 85*c* for connecting the wireless communication chipset 85*a* with the antenna and adjusting frequencies so as to transceive a desired bandwidth signal. It may further include a band pass filter 85*b* for removing unnecessary electromagnetic waves so as to minimize the effect of the electromagnetic waves on the human body. The band pass filter 85*b* is configured to allow only signals in a specific bandwidth to pass there through and not the other signals, so that only the signals necessary in the wireless communication can be radiated via the antenna 86 and the other signals may not be transmitted to the antenna 86.

The conventional antenna 86 is realized as a conductive strip printed on the case. The conductive strip is connected with the wireless communication chipset 2851 and signals are transceived via the conductive strip (if necessary, the conductive strip is grounded with or adjacent to the antenna 86). Such type of the antenna is a mono-pole antenna and the mono-pole antenna is realized as a conductive strip with a λ/4 length. Rather than the mono-pole antenna, PIFA (Plan Invert F Antenna) may be used.

Figure 5:
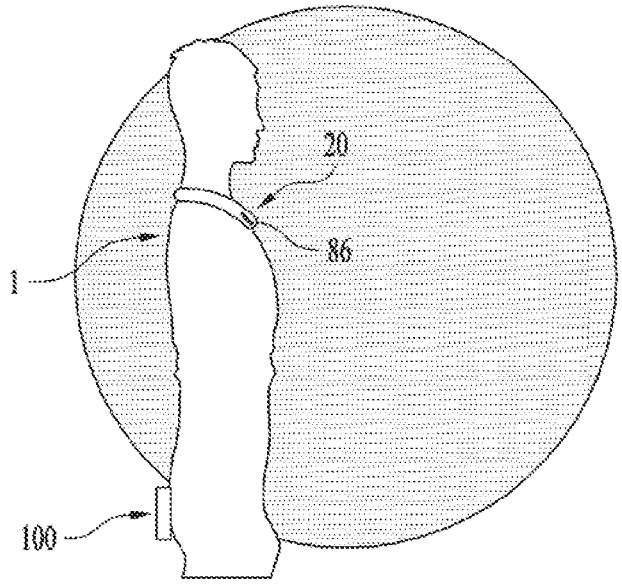
FIG. 5 is a diagram to compare the wireless communication performance of the conventional wearable device with that of the wearable device in accordance with the present disclosure.
Figure 5:
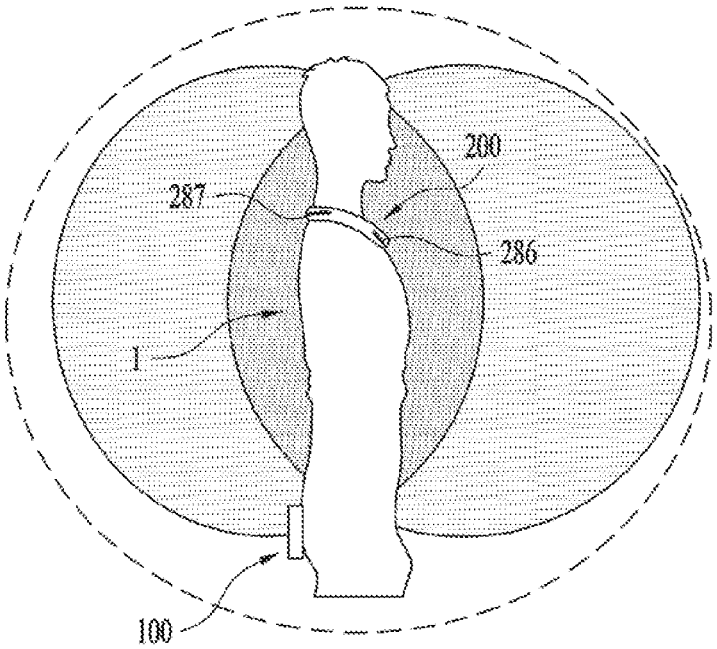

Such the conventional arrangement of the antenna 86 has no problem in case the other terminal 100 connected with the wearable device 20 is located in front the user's body. However, in case the other terminal 100 is located behind the user's body as shown in FIG. 5(*a*) (for example, in the user's back pocket or bag), the wireless communication performance might be deteriorated disadvantageously. FIG. 5(*a*) is a diagram to describe the wireless communication performance of the conventional wearable device 20. The antenna 86 of the conventional wireless is located toward the user's front and the electromagnetic waves are blocked by the user's back to weaken the wireless communication performance.

Figure 4:
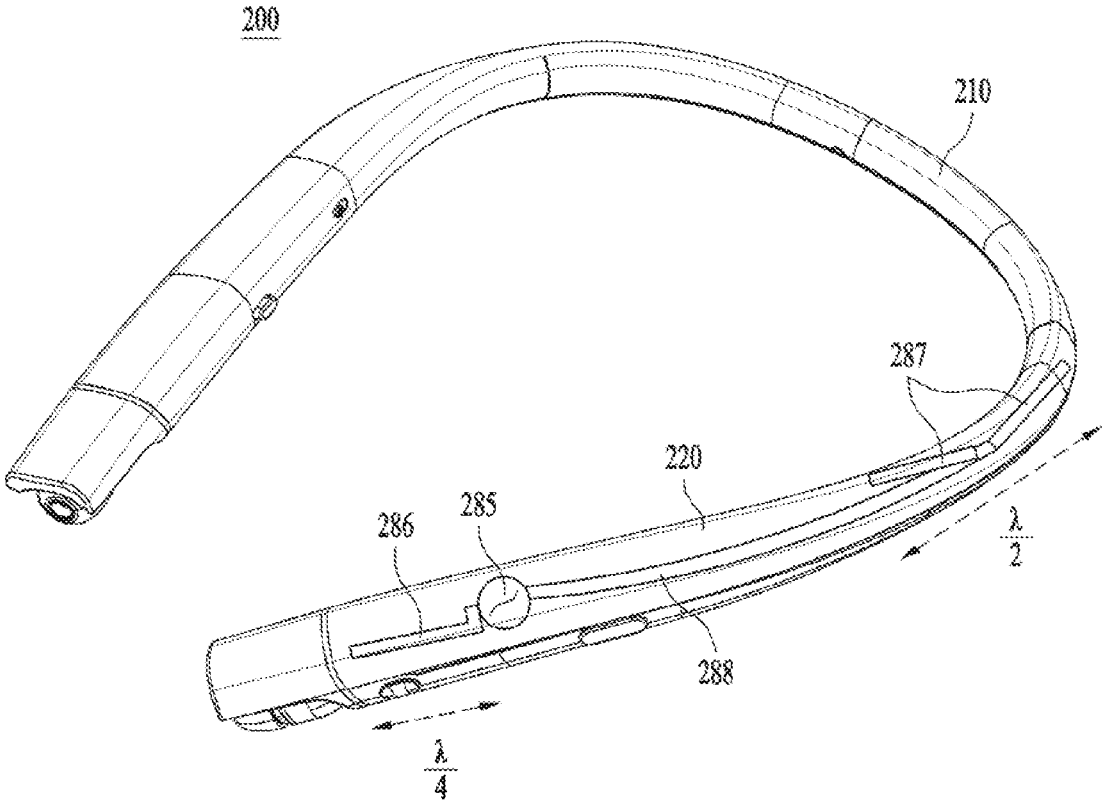
FIG. 4 is a diagram to describe antenna arrangement of a wearable device in accordance with one embodiment.
Figure 4:
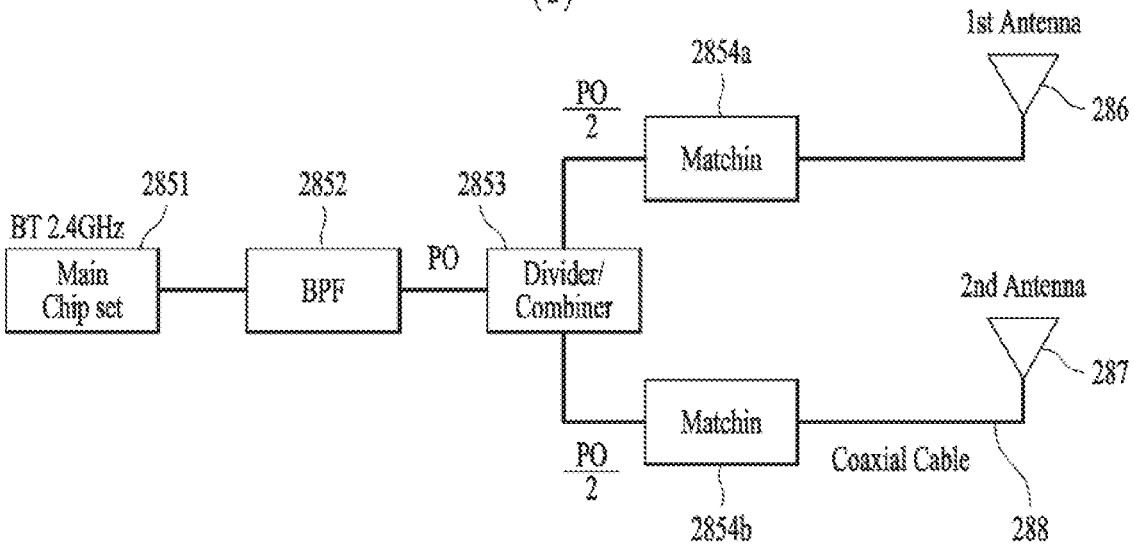

The embodiments provide a wearable device 200 further including an auxiliary antenna to solve such disadvantage. FIG. 4 is a diagram illustrating one example of the wearable device 200. Referring to FIG. 4(*a*), the antenna of the illustrated embodiment includes a first antenna 286 arranged toward the front when the user is wearing the wearable device 200 on the neck, like the conventional antenna; and a second antenna 287 arranged toward the user's back when wearing the wearable device 200 on the neck.

The second part of the wearable device 200 means a portion which facilitates transmission and reception of signals in a rear portion or a lateral rear portion with respect to the wearable device 200 worn on the user's neck.

The position is determined only if capable of preventing the second antenna 287 and the other terminal 100 located behind the user from interfering with the transmission and reception of the electromagnetic waves.

The second part as such the position may be a lateral portion or rear portion of the wearable device 200. The lateral portion may mean a lateral portion with respect to a center of the user's neck when the user is wearing the wearable device 200.

In an aspect of noise prevention, it is preferred that the second part is located in the rear center of the wearable device 200, in other words, the center of the band part 210. When the second antenna 287 is located in the band part 210, the second antenna 287 might damage in the deformation of the band part 210. Accordingly, the second antenna 287 may be arranged adjacent to the band part 210.

The first antenna 286 is located in an end region of the housing 220 and attached to a surface of the case defining an exterior of the housing 220 to minimize the effect of the electronic components loaded in the housing 220. If exposed outside, there are concerns about damage on the first antenna and deterioration of design quality. Accordingly, a method may be used that the first antenna 286 is attached to an inner surface of the case by directly realized in an inner surface of the case or in a flexible printed circuit board.

FIG. 5(*b*) is a diagram to describe the performance of the wearable device 200 in accordance with the present disclosure. The first antenna 286 located in the user's front is advantageous in transmitting and receiving signals when the other terminal 100 is located in front of the user. The second antenna 287 is advantageous in transmitting or receiving the signals when the other terminal 100 is located behind the user.

Referring to FIG. 4(*b*), the wireless communication unit 285 of the present disclosure includes two antennas 286 and 287 and one wireless communication chipset 2851. In the conventional MIMO method, the wireless communication chipsets 2851 receive signals from two antennas, respectively, so that two chipsets are required. However, the wireless communication unit 285 of the present disclosure uses one conventional wireless communication chipset 2851 so as to increase no cost increase caused by the wireless communication chipset replacement 2851.

To transmit signals by using two antennas and receive signals from the two antennas, a divider 2853 is used in distributing or combining signals. The divider 2853 is configured to distribute the electricity of the signal transmitted from the wireless communication chipset 2851 to the first antenna 286 and the second antenna 287. As the electricity divided in half is transmitted to the first antenna 286 and the second antenna 287, the performances of the antennas are deteriorated down to 3 dB. In this instance, the two antennas are operated at the same time and the overall radiation performance is not deteriorated a lot.

Even the wireless communication unit 285 of the wearable device 200 may include a bandpass filter 2852 in accordance with unwanted emission restriction regulations. Passing the bandpass filter 2852, the radiation of the antenna is lost about 1.5 dB. Accordingly, the bandpass filter 2852 may be removed in case of satisfying the unwanted emission restriction regulations.

FIG. 6 is a graph to describe the wireless communication performance of the conventional wearable device 20 and that of the wearable device 200 in accordance with the present disclosure. 'Single Antenna' means the conventional wireless communication unit 285 including only one antenna. 'Dual Antenna' means the wireless communication unit 285 including two antennas in accordance with the present disclosure.

'Channel Number' means that Bluetooth wireless communication has a plurality of channels dividing frequencies by 1 MHz as a unit. Accordingly, wireless communication is performable between two devices by setting channels when connecting the wearable device to the other terminal, without allowing them affected by other peripheral wireless communication devices.

'TRP' stands for Total Radiated Power meaning a value gained by measuring the maximum output power transmitted from a wireless device in three dimensions. TRP has +value. The larger value TRP has, the higher performance TRP has. Compared with the wireless communication structure of the conventional wireless communication unit 285, the wireless communication unit of the present disclosure has the improved maximum output power and average in each channel so as to have improved wireless performance.

'TIS' stands for Total Isotropic Sensitivity which means a measured value of reception sensitivity of a wireless device. An electric field of a base station is lowered down until a value which causes no data transmission error and the value of that electric field is measured in three dimensions as one value.

'TIS' means that the performance becomes better, as –value becomes larger. Compared with the conventional wireless communication unit including one antenna, the wireless communication unit has a lower electric power enough to deteriorate the performance a little bit but in an error range so that there may be little difference between actual performances. Even when the electricity is divided in half by using the divider 2853 and distributed to the first antenna 286 and the second antenna 287, the wireless communication performance may not be deteriorated more than the conventional wireless communication performance. Rather, the null point generated by the human body is removed so as to improve the wireless communication performance.

Figure 7:
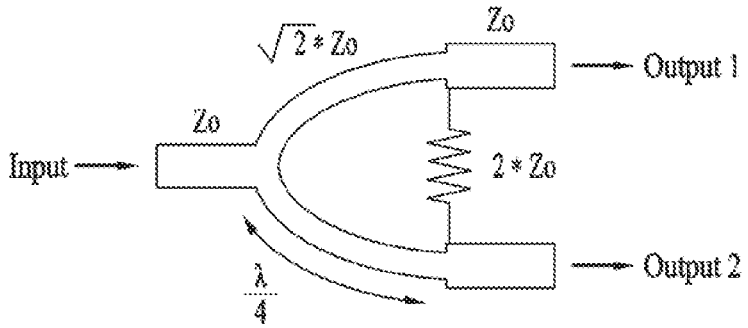
FIG. 7 is a diagram illustrating a wearable device in accordance with one embodiment.
Figure 7:
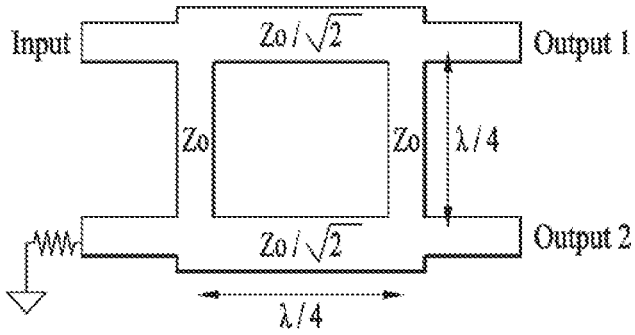

The divider 2853 is implemented to divide the electricity, in case of transmitting the signals output from the wireless communication chipset 2851 to each of the antennas and combine the signals received from each of the antennas and transmit the combined signal to the wireless communication chipset 2851. FIG. 7 is a diagram illustrating one embodiment of the divider 2853. As shown in FIG. 7(*a*), the divider 2853 is realized as a strip line (or a micro-strip line) printed on the main board 281. Alternatively, as shown in FIG. 7(*b*), the electricity is able to be divided by using a hybrid coupler. Although not shown in the drawings, the divider 2853 may be realized by combining lumped elements.

Another divider 2853 may be further provided to re-divide the electricity transmitted to the first or second antenna 286 or 287 and transmit P0/4 of the electricity to a third antenna, so that signal transceiving can be performed via the third antenna. In other words, the number of the antennas is increased, not limited to two.

Instead of the divider 2853, a switch is used in transmitting the signal output from the wireless communication chipset 2851 to the first antenna 286 and the second antenna 287 selectively. When sensing the deterioration of the wireless communication performance during the signal transceiving, the wireless communication chipset 2851 controls the switch to transmit a signal to the second antenna (the reverse case is possible).

Figure 8:
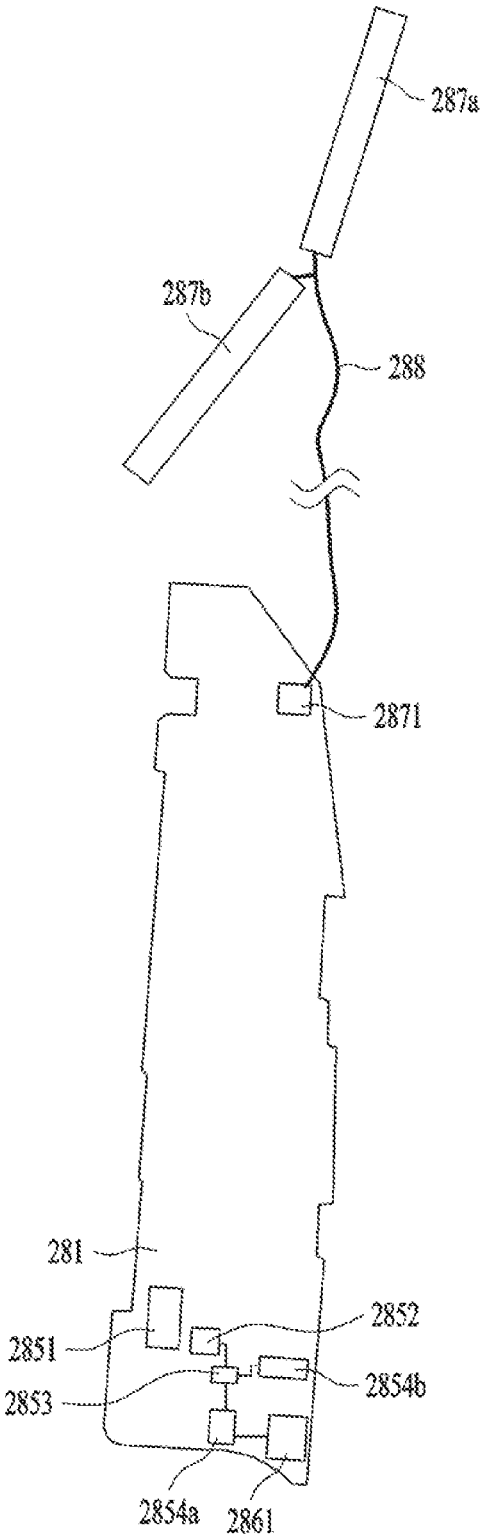
FIG. 8 is a diagram illustrating a main printed circuit board and a second antenna which are provided in the wearable device.

FIG. 8 is a diagram illustrating the main board 281 and the second antenna 287 of the wearable device 200. The wireless communication unit 285 in accordance with the present disclosure (the wireless communication chipset 2851, the bandpass filter 2852, the divider 2853 and the matching circuit 2854*a* and 2854*b*) may be realized on the main board 281. The first antenna 286 is arranged adjacent to the region where the main board 281 is mounted so as to be connected with the matching circuit (2854*a* and 2854*b*) by using a connection structure such as a C-clip mounted on the main board 281.

In this instance, the second antenna 287 has to be toward the user's back as mentioned above and it has to be spaced apart from the wireless communication chipset 2851 and divider 2853 which are mounted on the main board 281. To connect the divider 2853 and the second antenna 287 spaced apart from each other, a conductive signal line such as a flexible printed circuit board or a coaxial cable may be used. When the wireless communication chipset 2851 and the divider 2853 are formed in a predetermined portion of the main board 281, the second antenna 287 and the connection unit 2871 are connected in the other portion of the main board 281 by the strip line on the main board 281. The connection unit of the second antenna 287 is connected with the second antenna 287 by an auxiliary signal line.

In case a conductive pattern such as the flexible printed circuit board is exposed outside, radiation of the signal is generated in the conductive pattern to cause loss and deterioration the performance. Also, the frequency matching might occur and it is preferred that the coaxial cable 288 is used. However, if necessary, a flexible printed circuit board or a printed circuit board may be used for electrical connection.

Especially, in case the area of the printed circuit board loaded in the housing 220 is large, it is preferred that the second antenna 287 is connected without any auxiliary configurations.

Figure 9:
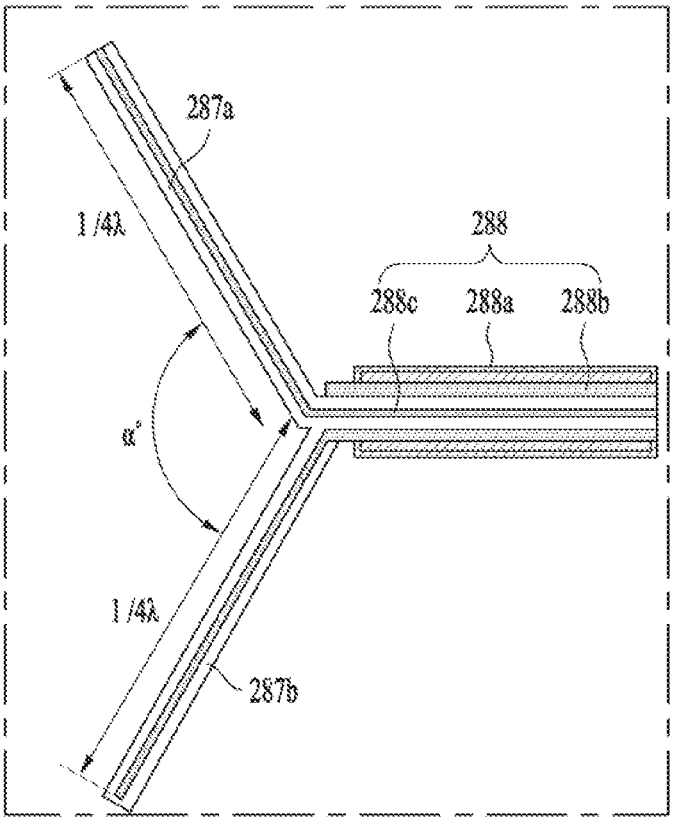
FIG. 9 is a sectional diagram illustrating a coaxial cable and the second antenna which are provided in the wearable device.

FIG. 9 is a sectional diagram illustrating the second antenna 287 and the coaxial cable 288 of the wearable device 200. The coaxial cable 288 includes a first coated portion with a core 288*c* located in a center and surrounding the core 288*c*; a ground shield 288*b* including a conductive material surrounding the first coated portion; and an insulated coating 288*a* surrounding the shield 288*c*.

The coaxial cable 288 having the layer structure is able to prevent the antenna radiation performance deterioration caused by the leakage of the signal of the core 288*c*, because the core 288*c* is surrounded by the shield 288*b*. The ground shield 288*b* is made of a broad conductive material and serves as a ground, so as to extend the ground and signal line to the housing 220 where the second antenna 287 is located and an edge portion of the band part 210.

The second antenna 287 of the present disclosure may use a dipole antenna. The dipole antenna is configured to realize the antenna by using two radiators. The two radiators includes a first radiator 287*a* connected with the signal line (the core 288*c*) supplying the electricity and a second radiator 287*b* connected with the shield 288*b* functioned as the ground, so that the overall length of the two radiators 287*a* and 287*b* may satisfy the half-wave length of the wireless communication frequency.

The dipole antenna may be realized by the two radiators including one configured to receive the electricity and the other one connected with the ground. However, in a monopole antenna, a predetermined portion has to be arranged adjacent to the ground plane and it is then difficult for the second antenna 287 spaced apart from the main board 281 to realize the monopole antenna. Accordingly, it is proper that the second antenna 287 should be the dipole antenna, because it is spaced apart from the main board and connected with the main board by the coaxial cable 288.

Moreover, the dipole antenna has a characteristic of non-directivity so that a radiation pattern can be uniform, without weakening the intensity of the signal at a specific position only to have a high radiation characteristic. The first radiator 287*a* and the second radiator 287*b* shown in FIG. 9 may be bent in a V-shape. When they are bent in the V-shape (for example, $\alpha=120°$), the omnidirectional characteristic of the dipole antenna is improved more to generate less signal disconnection enough to improve the wireless communication performance. At this time, the V-shape is widened to the reverse direction of the coaxial cable 288.

In case of $\alpha=120°$, the first radiator 287*a* and the second radiator 287*b* may be arranged in I-shape.

When grounded not via the coaxial cable 288 but the flexible printed circuit board or the printed circuit board, the second antenna 287 may be a PIFA antenna and a monopole antenna as well as the dipole antenna.

As described above, the wearable device in accordance with the embodiments is capable of securing the wireless communication performance, regardless of the location of the other terminal wirelessly communicating with the wearable device. Especially, the wireless communication performance can be improved, using the conventional wireless communication chipset, and the wearable device has the advantage of no drastic rise in unit cost, compared with the conventional product.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A wearable device, comprising:

a body comprising a first body part and a second body part;

a main circuit board located in the first body part;

a wireless communication unit mounted on the main circuit board and being configured to transceive signals;

a divider mounted on the main circuit board and being coupled to the wireless communication unit;

a first antenna located in the first body part and being coupled to the divider;

a second antenna located in the second body part at a distance from the first antenna; and a coaxial cable connecting the divider and the second antenna, wherein the first body part is located at a front side of a user when wearing the wearable device, and the second body part is located at a lateral side or rear side of the user when wearing the wearable device.

2. The wearable device of claim 1, wherein the body comprises, a band part comprising elastic material; and a pair of housings respectively coupled to ends of the band part, and wherein the first body part is one end of one of the pair of housings, spaced at a distance from the band part, and the second body part is another end of one of the pair of housings, adjacent to the band part.

3. The wearable device of claim 1, wherein the second antenna is a dipole antenna comprising a first radiator connected to the wireless communication unit via the divider and a second radiator connected to a ground.

4. The wearable device of claim 3, wherein the coaxial cable comprises:

a signal line;

a ground shield located around the signal line; and an insulated coating surrounding the ground shield, wherein the first radiator is connected to the signal line and the second radiator is connected to the ground shield.

5. The wearable device of claim 3, wherein the first radiator and the second radiator are arranged in a V-shape or an I-shape.

6. The wearable device of claim 1, wherein the divider is configured to:

divide and transmit electricity output from the wireless communication unit to the first and second antennas; and combine and transmit signals received from the first and second antennas to the wireless communication unit.

7. The wearable device of claim 1, wherein the divider comprises at least one of a conductive pattern, a lumped element, or a coupler.

8. The wearable device of claim 1, further comprising:

a controller circuit configured to:

control the divider to connect the second antenna to the wireless communication unit, when wireless communication performance of the first antenna is below a defined threshold, wherein the divider comprises a switch for selectively connecting the wireless communication unit to either the first antenna or the second antenna.

9. The wearable device of claim 1, further comprising:

one or more auxiliary dividers located between the divider and the first antenna; and a third antenna connected to the one or more auxiliary dividers.

10. A wearable device, comprising:

a body;

a transceiver located in the body and being configured to transceive signals;

a first antenna located in the body at a location that corresponds to a first side of a user when the wearable device is being worn;

a second antenna located in the body at a distance from the first antenna and at a location that corresponds to a second side of the user when the wearable device is being worn; and a circuit located in the body and coupling the transceiver to the first antenna and to the second antenna, wherein the circuit is configured to:

divide and transmit electricity received from the transceiver to the first antenna and the second antenna; and combine and transmit signals received from the first antenna and the second antenna, wherein the second antenna is a dipole antenna comprising a first radiator connected to the wireless communication unit via the divider and a second radiator connected to a ground.

* * * * *